US011673726B2

(12) United States Patent
Warmus

(10) Patent No.: US 11,673,726 B2
(45) Date of Patent: Jun. 13, 2023

(54) GAME CARD CARRIERS

(71) Applicant: R. R. DONNELLEY & SONS COMPANY, Chicago, IL (US)

(72) Inventor: James L. Warmus, LaGrange, IL (US)

(73) Assignee: R. R. Donnelley & Sons Company, Chicago, IL (US)

( * ) Notice: Subject to any disclaimer, the term of this patent is extended or adjusted under 35 U.S.C. 154(b) by 335 days.

(21) Appl. No.: 16/854,672

(22) Filed: Apr. 21, 2020

(65) Prior Publication Data

US 2020/0331680 A1 Oct. 22, 2020

Related U.S. Application Data

(60) Provisional application No. 62/837,061, filed on Apr. 22, 2019.

(51) Int. Cl.

| | |
|---|---|
| ***A63F 1/06*** | (2006.01) |
| ***B65D 75/20*** | (2006.01) |
| ***B65D 75/56*** | (2006.01) |
| ***B65D 65/12*** | (2006.01) |
| ***B65D 75/52*** | (2006.01) |
| *B65D 65/18* | (2006.01) |

(52) U.S. Cl.

CPC ..... *B65D 75/20* (2013.01); *A63F 1/062* (2013.01); *B65D 65/12* (2013.01); *B65D 75/522* (2013.01); *B65D 75/566* (2013.01); *B65D 65/18* (2013.01)

(58) Field of Classification Search

CPC ..... A63F 1/062; B65D 75/02; B65D 75/04; B65D 75/14; B65D 75/20; B65D 75/22; B65D 75/522; B65D 75/525; B65D 75/566; B65D 27/28; B65D 65/04; B65D 65/10; B65D 65/12; B65D 73/0078; B65D 73/0085; B65D 77/006; B65D 75/30; B65D 75/32; B42F 7/04; B42F 7/02; B42F 7/025; B42F 7/06; B42F 7/065; B42F 7/08

USPC ..... 229/87.01, 87.06, 67.1–67.4, 77; 150/147, 149; 206/449, 455, 597, 39, 206/39.7, 784, 450, 424, 425; 40/124.06, 40/661.08, 665, 771, 774; 383/78

See application file for complete search history.

(56) References Cited

U.S. PATENT DOCUMENTS

| | | | | |
|---|---|---|---|---|
| 566,821 | A * | 9/1896 | Van Alstine | B42F 17/02 229/125.38 |
| 709,464 | A * | 9/1902 | Broach | B65D 85/07 229/87.01 |
| 883,662 | A | 3/1908 | McElree | |
| 1,221,884 | A * | 4/1917 | Martin | B42F 7/06 229/101 |

(Continued)

FOREIGN PATENT DOCUMENTS

| | | |
|---|---|---|
| FR | 2 708 572 | 2/1995 |

*Primary Examiner* — Jes F Pascua
*Assistant Examiner* — Nina K Attel
(74) *Attorney, Agent, or Firm* — McCracken & Gillen LLC

(57) ABSTRACT

A game card carrier is disclosed that has a first panel having a first interior surface and a first edge, a second panel having a second interior surface and a second edge. The first panel and the second panel are disposed such that the first interior surface and the second interior surface face one another, the first edge is in alignment with the second edge. A band overlays at least a portion the first panel and at least a portion of the second panel to hold the first panel and the second panel adjacent one another.

15 Claims, 13 Drawing Sheets

(56) References Cited

U.S. PATENT DOCUMENTS 1,634,064 A * 6/1927 Ahlquist ..... B42F 7/06 206/451
2,210,385 A * 8/1940 Salfisberg ..... B65D 75/28 206/784
2,318,677 A * 5/1943 Delson ..... A45C 1/06 150/149
2,614,737 A 10/1952 Parker
2,850,160 A 11/1956 Siebel et al.
2,833,461 A 5/1958 Brom
2,996,174 A * 8/1961 Will ..... A24F 27/04 206/104
3,089,590 A 5/1963 Mell
3,124,299 A 3/1964 Stone et al.
3,173,540 A * 3/1965 Lapides ..... B65D 73/0092 206/463
3,486,615 A 12/1969 De Woskin
3,963,121 A 6/1976 Kipp
3,970,242 A 7/1976 Swafford
4,015,350 A * 4/1977 Zurwelle ..... B42F 17/02 D19/76
4,502,596 A * 3/1985 Saetre ..... B65D 75/566 383/122
4,570,787 A 2/1986 Forbes, Jr.
4,874,092 A * 10/1989 Lara ..... B65D 85/00 206/455
4,899,877 A 2/1990 Kiernan
5,042,652 A * 8/1991 Grindrod ..... B65D 75/02 206/557
5,048,676 A 9/1991 Borgis et al.
5,072,876 A 12/1991 Wilson
5,379,894 A 1/1995 Haas et al.
5,429,238 A * 7/1995 Fritz ..... B42F 7/025 206/424
5,601,681 A * 2/1997 Bayro ..... B42F 7/06 150/147
5,775,504 A 7/1998 Menaged
5,823,333 A * 10/1998 Mori ..... G11B 33/0494 206/312
5,842,567 A 12/1998 Rowe et al.
5,947,297 A 9/1999 Aoki et al.
6,012,580 A 1/2000 Peters et al.
6,050,416 A 4/2000 Blin et al.
7,143,892 B2 12/2006 Kolton et al.
8,893,881 B2 * 11/2014 Schneider ..... A45C 1/06 206/472
9,701,455 B2 7/2017 Jones et al.
10,336,522 B2 7/2019 Jones et al.
10,696,461 B2 6/2020 Jones et al.
2001/0022318 A1 9/2001 Kaden et al.
2002/0036151 A1 3/2002 Deiger
2006/0124495 A1 6/2006 David et al.
2013/0062342 A1 3/2013 Hansen et al.
2013/0220879 A1 8/2013 Glass et al.
2014/0103100 A1 4/2014 Falcon et al.
2014/0231293 A1 8/2014 Nietvelt
2020/0165046 A1 5/2020 Jones et al.

* cited by examiner

GAME CARD CARRIERS

CROSS-REFERENCE TO RELATED APPLICATIONS

The present application claims benefit of Warmus, U.S. Provisional Patent Application Ser. No. 62/837,061, filed on Apr. 22, 2019, and entitled "Game Card Packaging." The entire contents of this application are incorporated herein by reference.

FIELD OF DISCLOSURE

The present subject matter relates to packaging, and more particularly, to packaging for game cards.

BACKGROUND

Collectible cards, such as game cards, are typically enclosed in a plastic or pliable pack. The pack may then be disposed in additional packaging such as a carrier that facilitates displaying the pack in a retail establishment and that protects the pack and the cards contained therein from tampering or removal from the carrier prior to sale. Such carrier is generally manufactured from a semi-rigid material such as paperboard and includes a cavity or pocket into which the pack may be disposed. The pack and the carrier are generally imprinted with information that identifies the collectible cards contained therein and additional marketing materials to promote sale of the collectible cards.

Advantages and aspects of the embodiments disclosed herein will become apparent upon consideration of the following detailed description and the attached drawings wherein like numerals designate like structures throughout the specification.

SUMMARY

According to one aspect, a game card carrier includes a first panel having a first interior surface and a first edge, a second panel having a second interior surface and a second edge, a connecting portion that joins the first panel and the second panel, a game card disposed between the first and second panels, and a band. The first panel and the second panel are disposed such that the first interior surface and the second interior surface face one another, the first edge is in alignment with the second edge, the connecting portion is accordion folded and substantially enclosed between the first panel and the second panel, and the band overlays at least a portion of the first panel and at least a portion of the second panel to hold the first panel and the second panel adjacent one another. In addition, the game card carrier includes an aperture therethrough and a height of the band along the first edge is larger than a height of the game card.

According to another aspect, a game card carrier includes a first panel having a first interior surface and a first edge, a second panel having a second interior surface and a second edge, a connecting portion that joins the first panel and the second panel, and a band. The first panel and the second panel are disposed such that the first interior surface and the second interior surface face one another, the first edge is in alignment with the second edge, the connecting portion is accordion folded and substantially enclosed between the first panel and the second panel, the band overlays at least a portion of the first panel and at least a portion of the second panel to hold the first panel and the second panel adjacent one another, and the game card carrier includes an aperture therethrough. Further, the first edge is substantially linear, the first panel includes a top edge and a bottom edge, a first angled edge connects the top edge and the first edge and a second angled edge connects the bottom edge and the first edge, the first angled edge forms an acute angle with the top edge, the second angled edge forms an acute angle with the bottom edge, and the band is disposed between the first angled edge and the second angled edge.

According to a further aspect, a game card carrier includes a first panel having a first interior surface and a first edge, a second panel having a second interior surface and a second edge, a connecting portion that joins the first panel and the second panel, a band, and an article disposed between the first panel and the second panel. The first panel and the second panel are disposed such that the first interior surface and the second interior surface face one another, the first edge is in alignment with the second edge, the connecting portion is accordion folded and substantially enclosed between the first panel and the second panel, and the band overlays at least a portion of the first panel and at least a portion of the second panel to hold the first panel and the second panel adjacent one another. In addition, the game card carrier includes an aperture therethrough and the first panel includes a window through which at least a portion of the article protrudes.

Other aspects and advantages will become apparent upon consideration of the following detailed description and the attached drawings wherein like numerals designate like structures throughout the specification.

DETAILED DESCRIPTION

Figure 1:
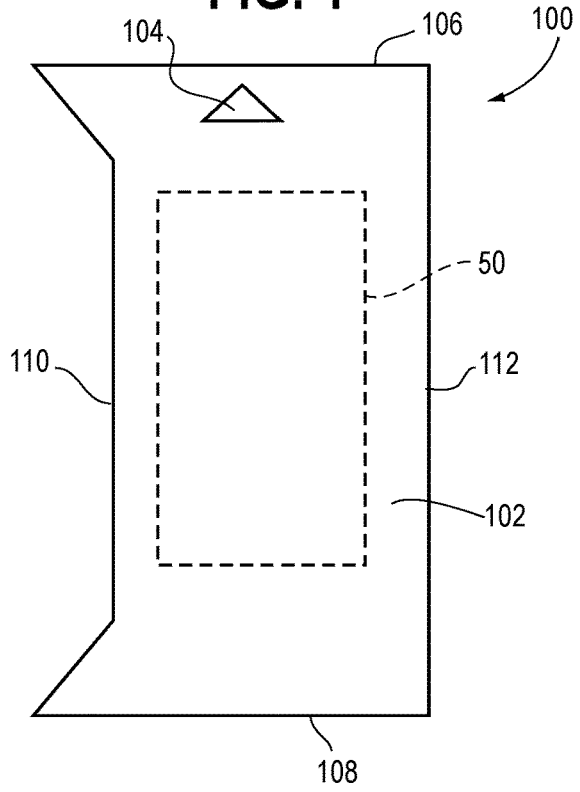
FIG. 1 is a plan view of a carrier.

Referring to FIG. 1, a pack of collectible cards 50 is disposed in a carrier 100. In one embodiment, the carrier 100 includes an exterior surface 102, a keyhole or aperture 104, a first side 106, a second side 108 opposite the first side 106, a third side 110 disposed between the first side 106 and the second side 108, and a fourth side 112 opposite the third side 110 and disposed between the first side 106 and the second side 108. The aperture 104 facilitates hanging the carrier 100 on a retail display.

Figure 2:
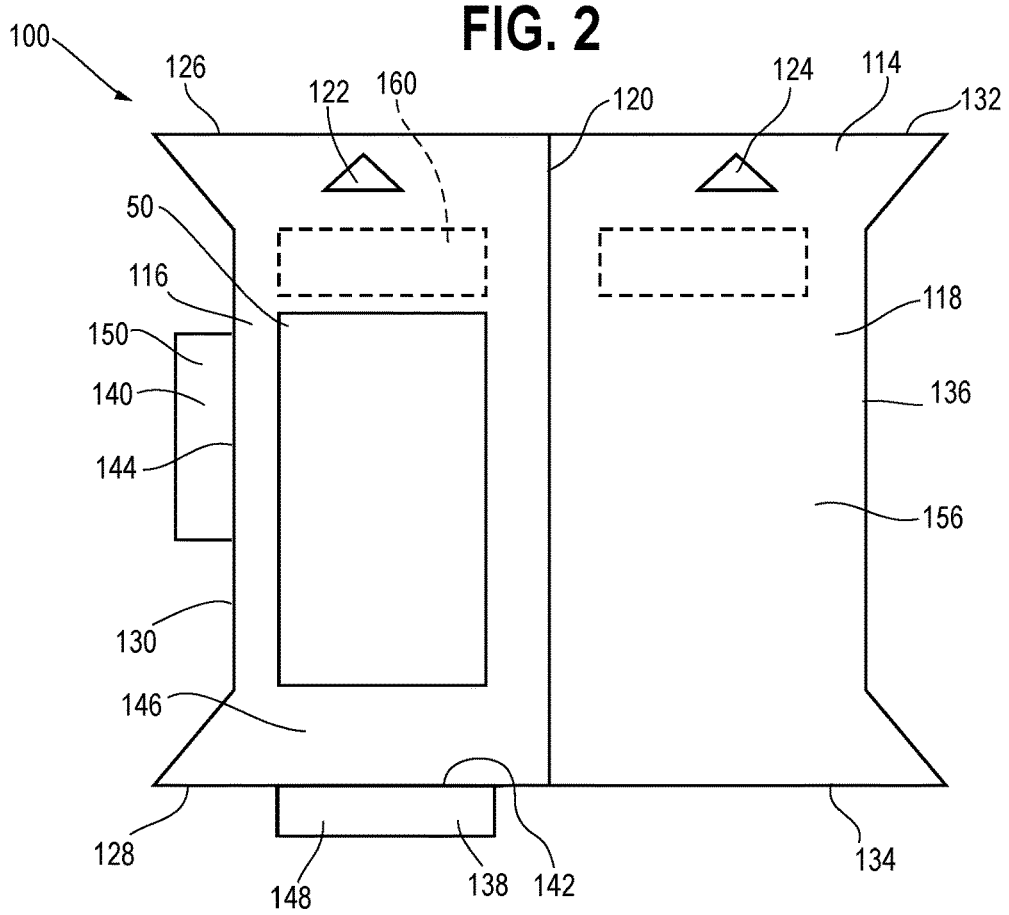
FIG. 2 is a plan view of an interior side of a substrate that may be used to form the carrier of FIG. 1.
Figure 3:
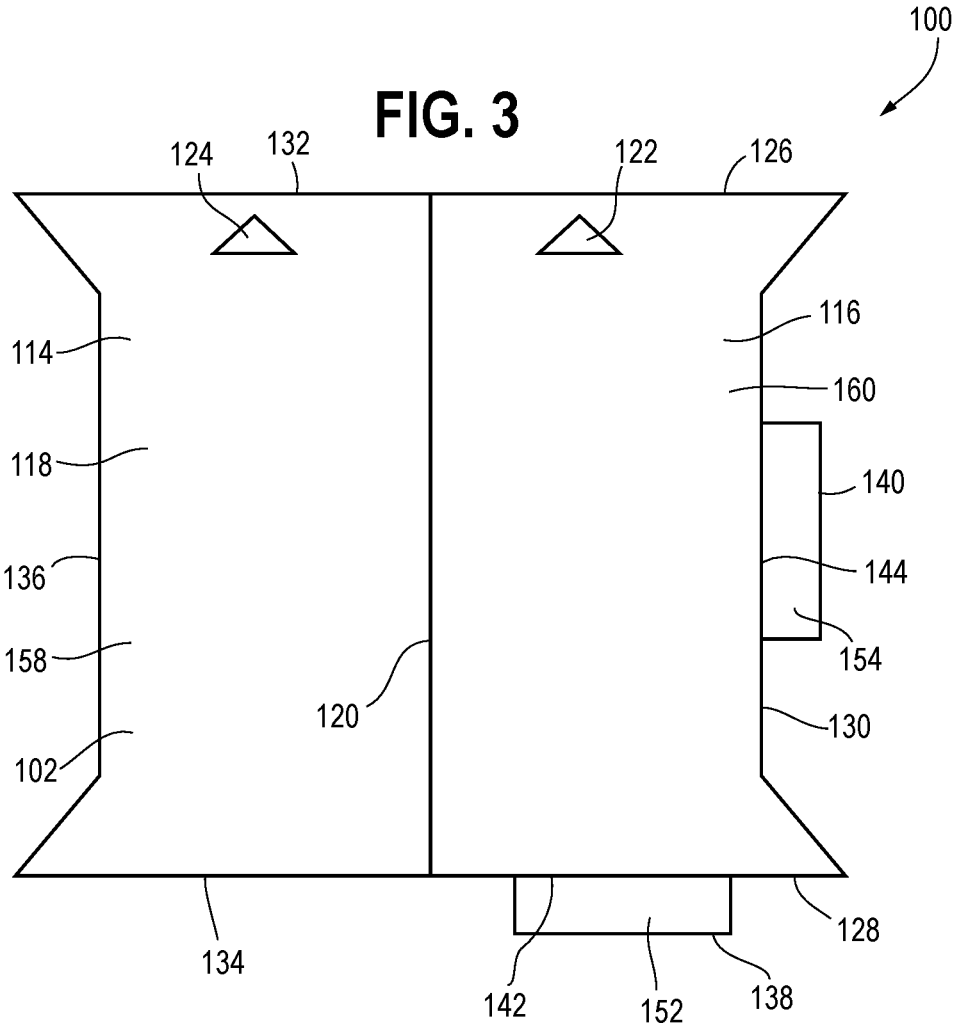
FIG. 3 is a plan view of an exterior side of the substrate of FIG. 2.

Referring also to FIGS. 2 and 3, in one embodiment, the carrier 100 is formed from a substrate 114. The substrate 114 includes a first panel 116 and a second panel 118 joined along a fold line 120. When folded, the fold line 120 is coincident with at least a portion of the fourth side 112. In some embodiments, the first panel 116 includes a first aperture 122 and the second aperture 124. The apertures 122 and 124 are disposed in the first and second panels 116,118 such that when the substrate 114 is folded along the line 120, such apertures 122,124 are aligned and form the aperture 104 of the carrier 100.

The first panel 116 includes a top edge 126, a bottom edge 128 opposite the top edge 126, and a side edge 130 disposed between the top edge 126 and the bottom edge 128. The second panel 118 includes a top edge 132, a bottom edge 134 opposite the top edge 132, and a side edge 136 disposed between the top edge 132 and the bottom edge 134.

In some embodiments, a first flap 138 extends outwardly from the bottom edge 128 of the first panel 116 and a second flap 140 extends outwardly from the side edge 130. The first flap 138 is connected to the first panel 116 by a fold line 142 and the second flap 140 is connected to the first panel 116 by a fold line 144.

In one embodiment, to enclose the pack of collectible cards 50, the pack of collectible cards 50 is placed on an interior surface 146 of the first panel 116. Thereafter, the first flap 138 is folded along the fold line 142 such that an interior surface 148 of the first flap 138 faces the interior surface 146 of the first panel 116, and the second flap 140 is folded along the fold line 144 such that an interior surface 150 of the second flap 140 faces the interior surface 146 of the first panel 116. Adhesive is applied to exterior surfaces 152,154 of the first and second flaps 138,140, respectively. The substrate 114 is thereafter folded along the fold line 120 such that an interior surface 156 of the second panel 118 faces the interior surface 146 of the first panel 116, the second panel 118 overlaps the first panel 116 and the pack of collectible cards 50, and the interior surface 156 of the second panel 118 contacts the adhesive disposed on the exterior surfaces 152,154 of the first and second flaps 138,140. Sufficient pressure is applied so the second panel 118 is secured to the first and second flaps 138,140, and thereby enclose the pack of collectible cards 50 between the first panel 116 and the second panel 118.

In some embodiments, to enclose the pack of collectible cards 50 placed on the interior surface 146 of the first panel 116, the substrate 114 is first folded along the fold line 120 so that the interior surface 156 of the second panel 118 faces the interior surface 146 of the first panel 116. Thereafter, adhesive is applied to the interior surfaces 148,150 of the first and second flaps 138,140, respectively, and the first and second flaps 138,140 are folded along the fold lines 142,144, respectively, such that the adhesive applied to the interior surfaces 148,150 contacts an exterior surface 158 of second panel 118 to secure the second panel 118 to the flaps 138,140 and thereby enclose the pack of collectible cards 50 between the first panel 116 and the second panel 118.

It should be apparent to one who has skill in the art, that the second panel 118 may be secured to the interior surface 148 of the first flap 138 and the exterior surface 154 of the second flap 140, or to the exterior surface 152 of the first flap 138 and the interior surface 150 of the second flap 140.

In some embodiments, the pack of collectible cards 50 is adhesively secured to the first panel 116 before the second panel 118 is folded thereover. Alternately, adhesive may be applied to the pack of collectible cards 50 and/or the interior surface of 156 of the second panel 118 to secure the pack of collectible cards 50 to the second panel 118. Further, it should be apparent to one of ordinary skill in the art that the pack of collectible cards 50 may be adhesively secured to both the first and the second panels 116,118.

In some embodiments, the first flap 138 may have dimensions such that when the first flap is folded along the fold line 142, at least a portion first flap 138 overlaps at least a portion of the pack of collectible cards 50. Similarly, the second flap 140 may have dimensions such that when the second flap 140 is folded along the fold line 144, a least a portion of the second flap 140 overlaps at least a portion of the collectible cards 50. In some embodiments, the dimensions of the first flap and the second flap 138,140 are such that when folded along the fold lines 142,144, respectively, at least a portion of the first flap and at least a portion of the second flap 138,140 overlap one another. In such cases, the first flap 138 and/or the second flap 140 may also overlap the pack of collectible cards 50.

In those embodiments in which portions the first flap 138 and/or the second flap 140 overlap the pack of collectible cards 50, such portions of the flaps 138,140 may be adhesively secured to the pack of collectible cards 50. In those embodiments in which portions of the flaps 138,140 overlap one another, such portions may also be adhesively secured to one another.

In some embodiments, adhesive is applied to a portion 160 of the interior surface 146 of the first panel 116 before the second panel 118 is folded thereover. After folding, the adhesive secures the portion 160 to a portion 162 of the interior surface 156 of the second panel 118 and thereby further secures the first and second panels 116,118 to one another.

In the foregoing, prior to folding of the second panel 118 over the first panel 116, the flaps 138 and 140 are shown as integral with or attached to the first panel 118. However, it should be apparent to one who has ordinary skill in the art, that one or both of the flaps 138,140 may be integral with or attached to the second panel 118. In addition, the first and the second panels 116,118 may include one or more additional flaps to facilitate securement of the first and second panels 116,118 to one another. Further, in some cases the carrier 100 may only include one of the flaps 138 or 140.

Referring to FIGS. 4-7, a carrier 200 in which the pack of collectible cards 50 may be disposed includes an exterior surface 202, a keyhole or aperture 204, a first side 206, a second side 208 opposite the first side 206, a third side 210 disposed between the first side 206 and the second side 208, and a fourth side 212 opposite the third side 210 and disposed between the first side 206 and the second side 208. The aperture 204 facilitates hanging the carrier 200 on a retail display.

In one embodiment the carrier 200 is formed from a substrate 214. The substrate 214 includes a first panel 216 and a second panel 218 joined to one another by a connecting portion 220. In some embodiments, the first panel 216 includes an aperture 222 and the second aperture 224.

The first panel 216 includes a top edge 226, a bottom edge 228 opposite the top edge 226, and opposing side edges 230,232 disposed between the top edge 226 and the bottom edge 228. The second panel 118 includes a top edge 234, a bottom edge 236 opposite the top edge 234, and opposing side edges 238,240 disposed between the top edge 234 and the bottom edge 236. The connecting portion 220 is connected to and extends between the side edge 232 of the first panel 216 and the side edge 240 of the second panel 214.

Fold lines 242,244 connect the connecting portion 220 to the first and second panels 216,218, respectively. A fold line 248 divides the connection portion 220 into a first section 250 and a second section 252. The first and second sections 250,252 include interior surfaces 254,256, respectively, and exterior surfaces 258,260, respectively.

A flap 262 extends outwardly from the side edge 230 of the first panel 216 and is connected to the first panel 216 by a fold line 264.

To enclose the pack of collectible cards 50 in the carrier 200, the pack of collectible cards 50 is placed on an interior surface 266 of the first panel 216. The connecting portion 220 is then accordion folded so that an interior surface 268 of the second panel 218 faces the interior surface 266 of the first panel 216 and the connecting portion 220 is substantially enclosed between the first panel 216 and the second panel 218.

In particular, to accordion fold the connecting portion 220, the substrate 214 is folded along the fold line 242 so that the interior surface 254 of the first section 250 of the connecting portion 220 faces the interior surface 266 of the first panel 216. Thereafter, the substrate 214 is folded along the fold line 248 so that the interior surface 256 of the second section 252 of the connecting portion 220 faces away from the interior surface 266 of the first panel 218. Finally, the substrate 214 is folded along the fold line 244 so that the interior surface 268 of the second panel 218 faces both the interior surface 266 of the first panel 218 and the interior surface 256 of the second section 252 of the connecting portion 220. When folded in this manner, the exterior surfaces 258,260 of the first and second sections 250,252, respectively, of the connecting portion 220 face one another.

Adhesive may be used to secure to one another the interior surface 254 of the first section 250 of the connecting portion 220 and the interior surface 266 of the first panel 216, the interior surface 256 of the second section 250 of the connecting portion and the interior surface 268 of the second panel 218, and/or the exterior surfaces 258,260 of the first and second sections 250,252, respectively of the connection portion 220.

The flap 262 is folded along the fold line 264 and adhesively secured to either the interior or the exterior surface 268,270 of the second panel 218, in a manner substantially identical to that used to secure the flap 140 to the second panel 118 of the carrier 100 (see FIGS. 1-3). It should be apparent to one who has ordinary skill in the art that additional flaps may be used to contain the pack of collectible cards 50 between the first and second panels 216,218 and/or to secure such panels to one another. For example, an additional flap (not shown) may extend from the bottom edge 228 that is used to secure the first and second panels 216,218 to one another in a manner substantially identical to that described above in connection with the use of the flap 138 to secure the first and second panels 114,116 of carrier 100 (see FIGS. 1-3).

Referring once again to FIGS. 1-3, it should be apparent to one who has ordinary skill in the art that the first flap 138 may be integral with the substrate 114 or may be a separate component that is attached to the exterior surface 102 of the carrier 100, the interior surface 146 of the first panel 116 of the carrier 100, or the interior surface 156 of the second panel 118 of the carrier 100. Similarly, the second flap 140 may be integral with the substrate 114 or may be a separate component that is attached to the exterior surface 102 of the carrier 100, the interior surface 146 of the first panel 116 of the carrier 110, or the interior surface 156 of the second panel 118 of the carrier 100.

Similarly, referring to FIGS. 4-7, it should be apparent to one who has ordinary skill in the art, the connecting portion 220 may be integral with the substrate 214 or may be integral with only one of the panels 216,218 that comprise the carrier 200 and secured to the other one of the panels 216,218. Alternately, the connecting portion 220 may be a separate component that is secured to both of the panels 216,218. If the connecting portion 220 is secured to one of the panels 216,218, such securement may be on the exterior surface 202 of the carrier 200, or one or more of the interior surface(s) 266,268 of the panels 216,218.

Figure 8:
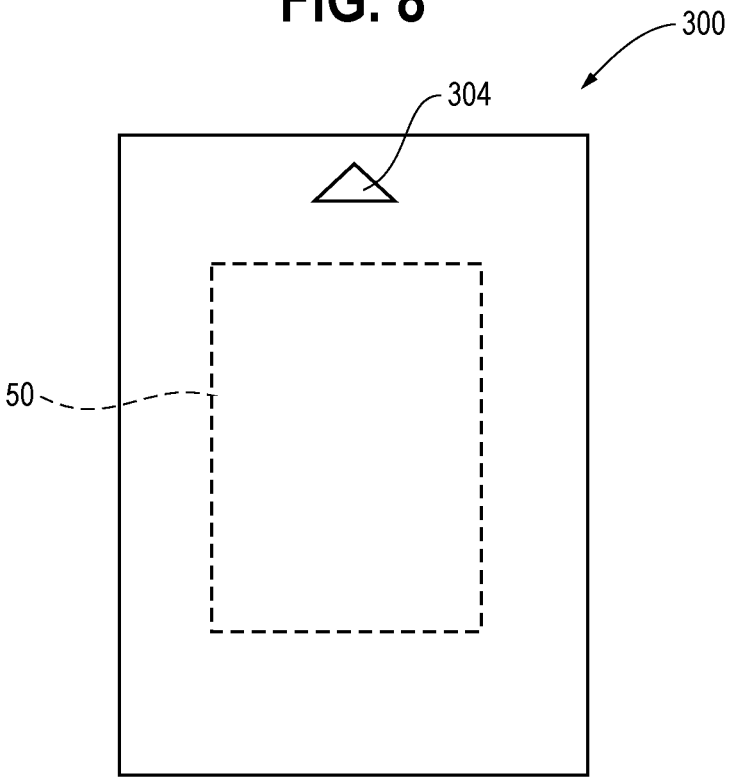
FIG. 8 is a plan view of yet another carrier.
Figure 9:
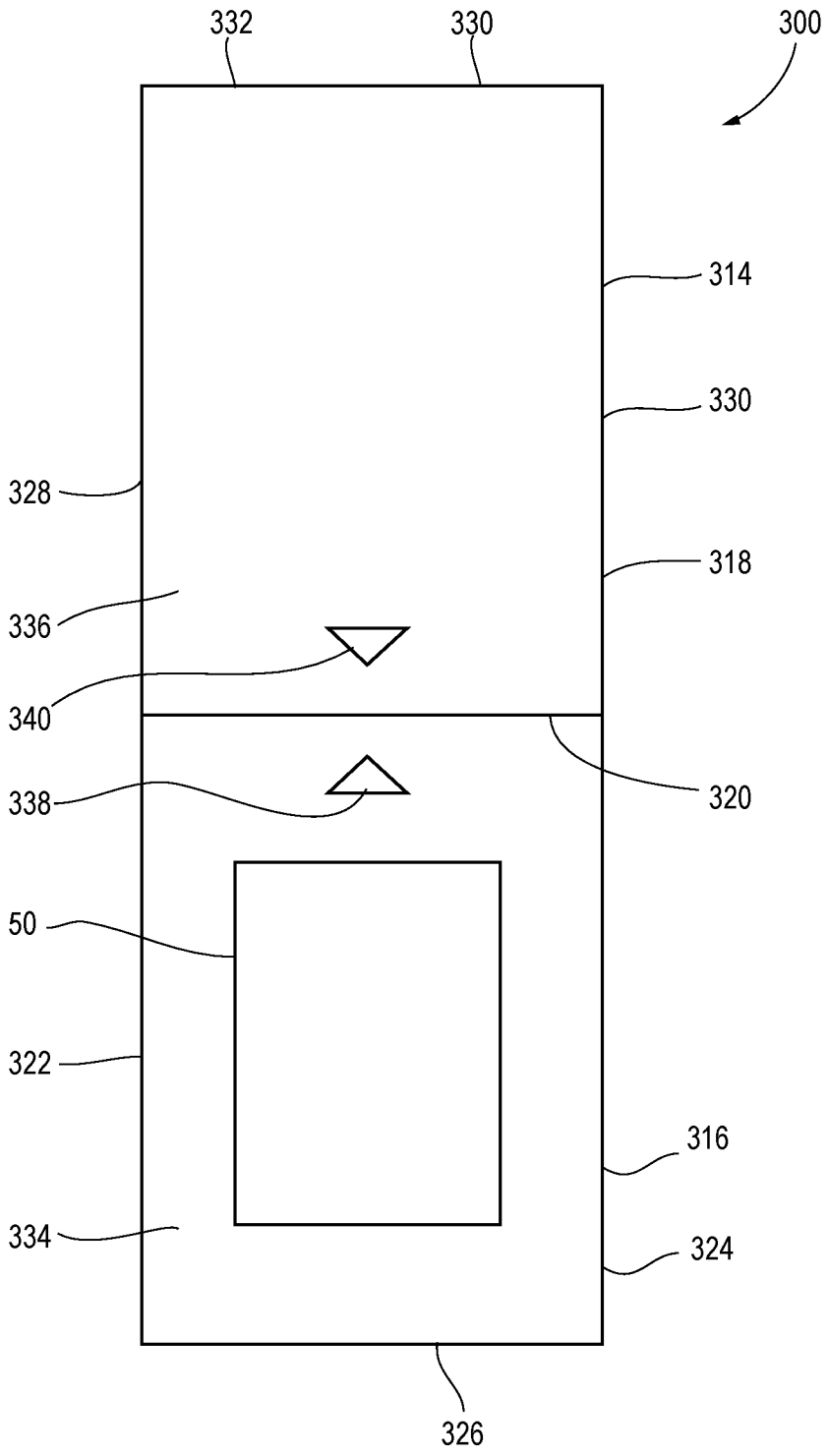
FIG. 9 is a plan view of an interior of a substrate that may be used to form the carrier of FIG. 8.

Referring to FIGS. 8 and 9, a carrier 300 for containing a pack of collectible cards 50 includes an exterior surface 302, a keyhole or aperture 304, a first side 306, a second side 308 opposite the first side 306, a third side 310 disposed between the first side 306 and the second side 308, and a fourth side 312 opposite the third side 310 and disposed between the first side 306 and the second side 308. The aperture 304 facilitates hanging the carrier 300 on a retail display.

The carrier 300 is formed from a substrate 314 and includes a first panel 316 and a second panel 318. The panels 316,318 are connected to one another along a fold line 320. The first panel 316 includes opposing first and second edges 322,324 and a third edge 326 disposed between the edges 322,324. The second panel 318 includes opposing first and second edges 328,330 and a third edge 332 disposed therebetween.

The first and second panels 316,318 also include interior surfaces 334,336, respectively.

To contain the pack of collectible cards 50 in the carrier 300, the pack of collectible cards 50 is placed, and optionally secured, to the first panel 316. Adhesive is applied to one the interior surface 334 of the first panel 314 proximate one or more of the edge(s) 322,324,326, and/or the fold line 320. Thereafter, the substrate 314 is folded along the fold line 320 so that the interior surfaces 334,336 of the first and second panels 314,316, respectively, face one another and the interior surface 336 of the second panel 316 contacts the adhesive disposed on the interior surface 334 of the first panel, thereby securing the first and second panels 314,316 to one another and enclosing the pack of collectible cards 50 therebetween.

The first and second panels 314,316 have apertures 338, 340 formed therein and positioned such that when the when the substrate 312 is folded along the fold line 320, the apertures 338,340 substantially align with one another the form the aperture 304 of the carrier 300.

It should be apparent that one or more flaps similar to those described above in connection with the carriers 100 and 200 may be disposed on the first and/or second panel(s) 314,316 to facilitate securing such panels to one another.

Figure 10:
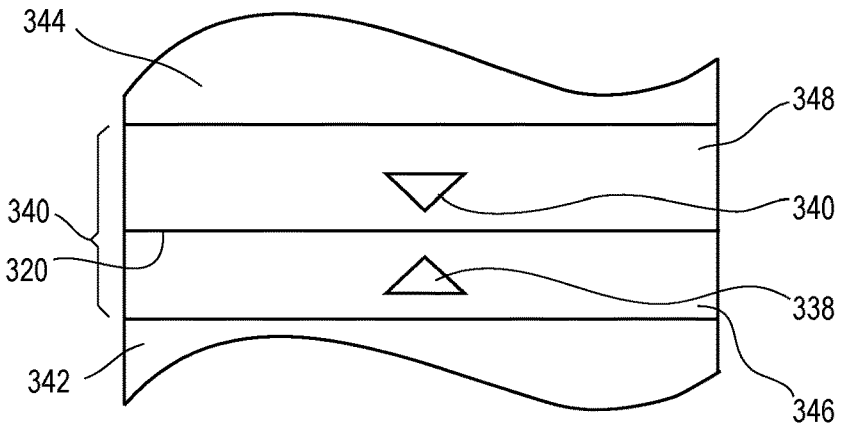
FIG. 10 is a fragmentary plan view of the interior portion of another substrate that may be used to form the carrier of FIG. 8.

Referring also to FIG. 10, in some embodiments the substrate 300 is formed from first, second, and third substrates 340,342,344 joined to one another. For example, the first substrate 340 includes the fold line 320 that divides such substrate into first and second portions 346,348 and the apertures 338 and 340 formed in the first and second portions 344,346, respectively. The first portion 346 is joined, for example, adhesively, to the second substrate 342 to form the first panel 316. The second portion 348 of the first substrate 340 is joined to the third substrate 344 to form the second panel 318. It should be apparent to one who has ordinary skill in the art that fewer or more substrates may joined to one another to form the first and second panels 316,318.

Figure 11:
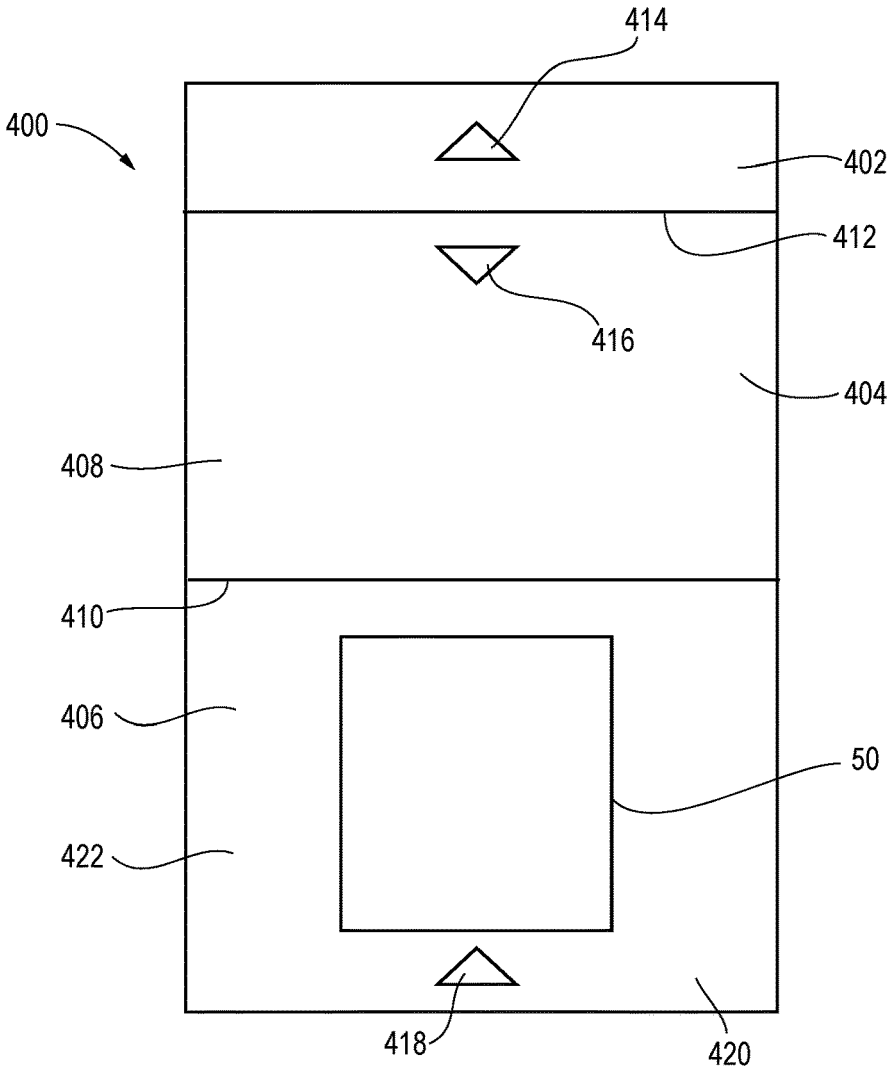
FIG. 11 is a plan view of an interior portion of yet another substrate that may be used to form the carrier of FIG. 8.

Referring to FIG. 11, the carrier 300 may be formed from a substrate 400 that includes a flap 402 disposed at top portion 404 thereof. The substrate 400 also includes a first panel 406 and a second panel 408 joined to one another along a first fold line 410. The flap 402 is joined to the second panel 408 along a second fold line 412. First and second apertures 414,416 are formed in the flap 402 and a top portion 418 of the second panel 408, respectively. A third aperture 418 is formed along a bottom portion 420 of the first panel 406. To enclose the pack of collectible cards 50, the pack of collectible cards 50 is disposed on an interior surface 422 of the first panel 406, and the substrate 400 is folded along the second fold line 410 such that an interior surface 424 of the second panel 408 faces the interior surface 422 of the first panel 406. The flap 402 is folded along the first fold line 412 and secured to either the interior surface 422 or an exterior surface (not shown) of the first panel 406. The first, second, and third apertures 414,416,418 are disposed such that when the substrate 400 is folded as described above, such apertures align substantially to form the aperture 304 of the carrier 300 (see FIG. 8).

The portion of the substrate 314 or 400 proximate the fold lines 320 and 400, respectively, may be accordion folded in accordance with the thickness of the pack of collectible cards 50 disposed in the carrier 300 formed from such substrate. Alternately, such substrate may be square folded along the fold lines 320,400 in accordance with the thickness of the pack of collectible cards 50 disposed therein.

Figure 12:
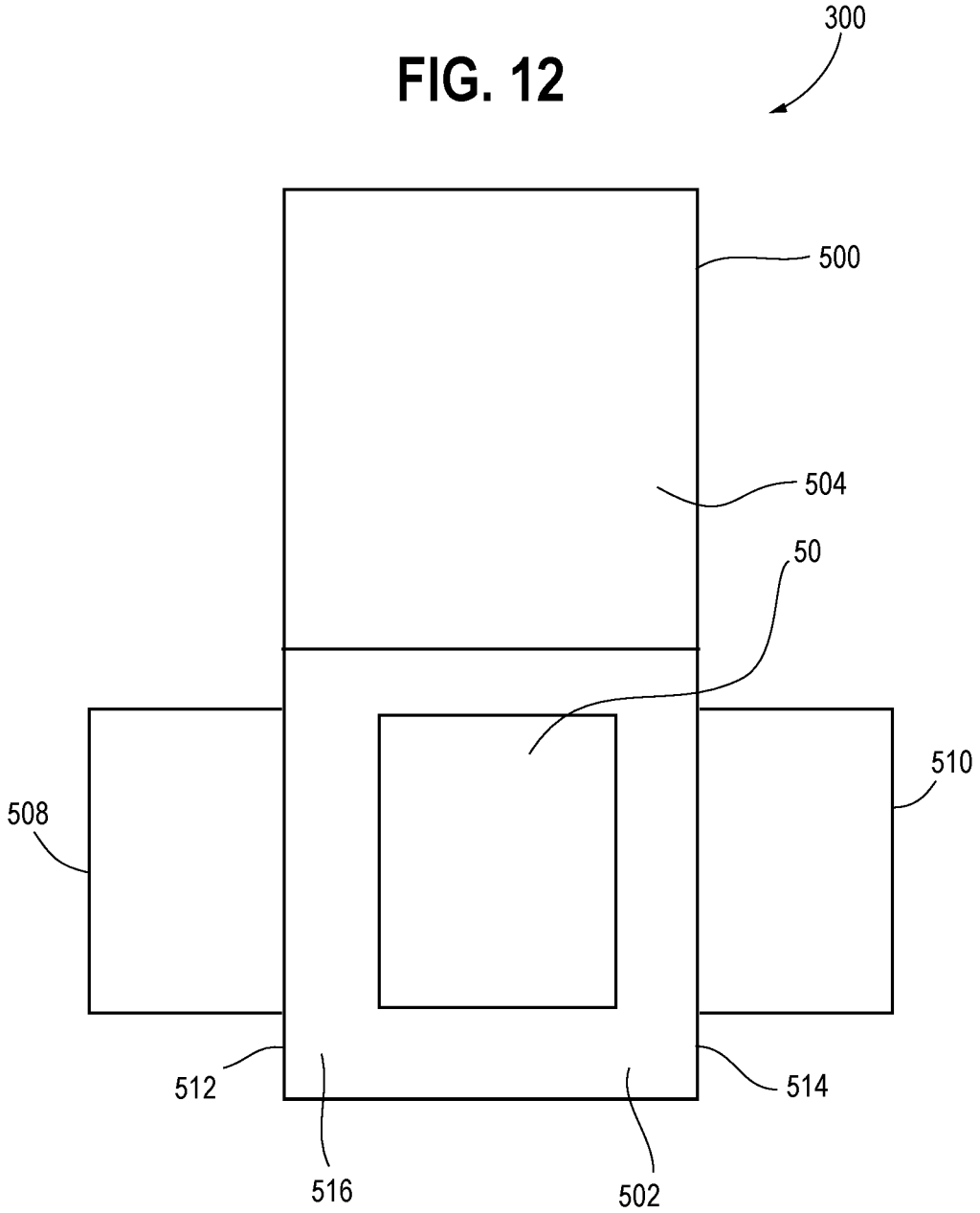
FIG. 12 is a plan view of an interior portion of an additional substrate that may be used to form the carrier of FIG. 8.

Referring to FIG. 12, another embodiment of a substrate 500 to form the carrier 300 includes a first panel 502 and a second panel 504 separated by a fold line 506. The substrate 500 also includes flaps 508 and 510 disposed on opposing edges 512,514 of the first panel 502. The pack of collectible cards 50 is disposed on an interior surface 516 and the flaps 508 and 510 are folded over the pack of collectible cards 50. The dimensions of the flaps 508 and 510 are such that such flaps overlap one another when folded over the pack of collectible cards 50. In some embodiments, after folding the flaps are adhesively secured to one another. In other embodiments, one flap 508 or 510 includes a tab (not shown) and the other flap includes a slit (not shown) into which such tab may be inserted to mechanically join the two flaps 508,510 to one another. The second panel 504 is folded along the fold line 506 and secured to the first panel 502 as described. It should be apparent that the flaps 508,510 may be disposed along adjacent edges of the panel.

Referring once again to FIG. 11, the substrate 400 may include only the aperture 414, and the first panel 406 may have dimensions such that when the carrier 300 is formed, such panel does not extend beyond the fold line 412.

Any of the panels that comprise the carriers described herein may include a window that allows at least a portion of the pack of collectible cards 50 disposed therein to be visible. Such window may be an open aperture or may be an aperture sealed with a transparent material. The panel having such window may be imprinted with a first portion of an image and the portion of the pack of collectible cards 50 visible through such window may be imprinted with a second portion of the image such that the first and second portions of the image combine to form a complete image.

Figure 13:
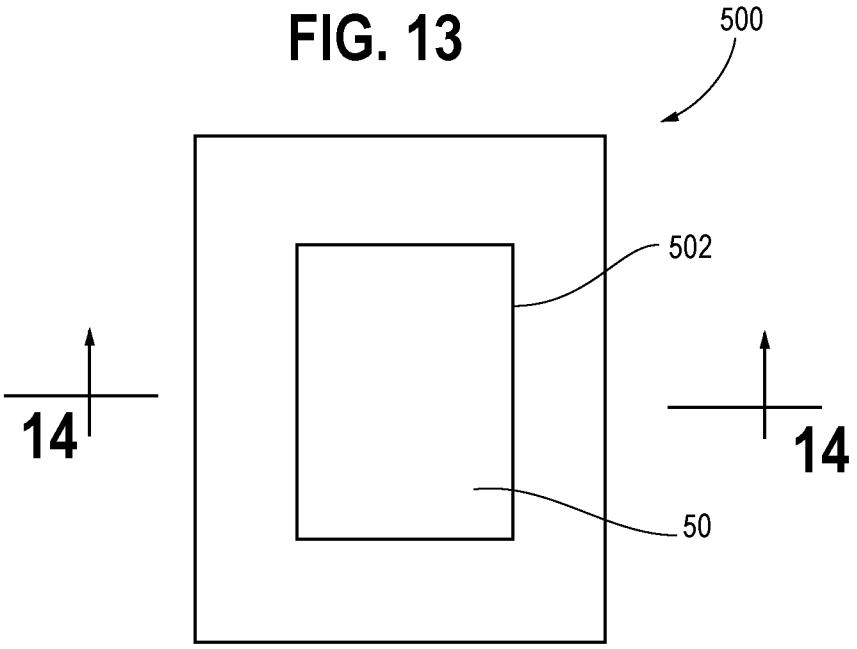
FIG. 13 is a plan view of a further carrier.
Figure 14:
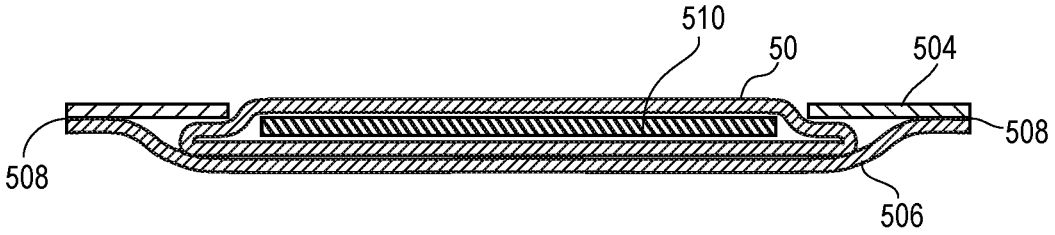
FIG. 14 is a sectional view of the carrier of FIG. 13 taken along the line 14-14 of FIG. 13.

Referring to FIGS. 13 and 14, the carrier 500 includes a window 502 through which a portion of the pack of collectible cards 50 disposed in the carrier 500 protrudes. The carrier 500 includes a first panel 504 and a second panel 506 joined to one another along a perimeter 508 thereof with the pack of collectible cards 50 disposed therebetween. In some embodiments, at least a portion of one card 510 disposed in the pack of collectible cards 50 is protrudes outwards into the window 502.

In some embodiments, windows may be formed in both the first panel 504 and 506 and portions of the pack of collectible cards 50 may protrude outwardly through each window. Alternately, the carrier may contain a first pack of collectible cards 50 and a second pack of collectible cards (not shown), and a portion of the first pack of collectible cards 50 may protrude through the window 502 formed in the first panel 504 and a portion of the second pack of collectible cards (not shown) may protrude through the window (not shown) formed in the first panel 506. It should be apparent that the windows formed in such embodiments need not be identical in shape and/or dimensions.

Having a portion of the pack of collectible cards 50 protrude through one or more windows in the carrier may allow such carrier to have a substantially thin (flat) configuration and thus allow the carrier to occupy less space (i.e., more such carriers may fit in retail display than carriers that are not flat).

Figure 15:
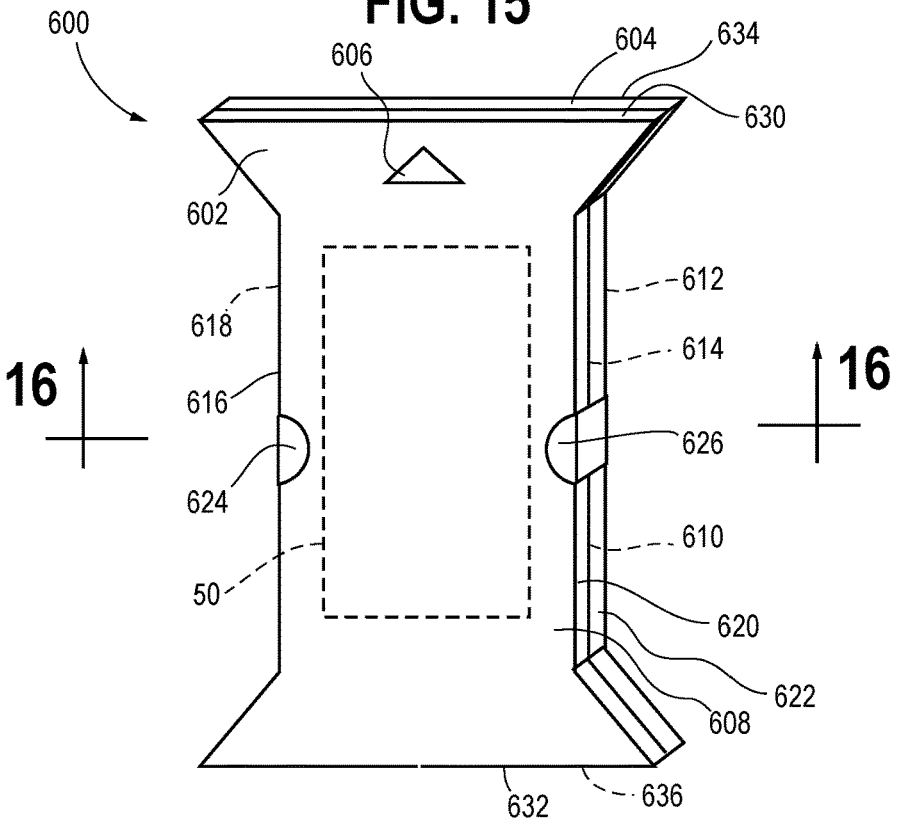
FIG. 15 is a plan view of another carrier.
Figure 16:
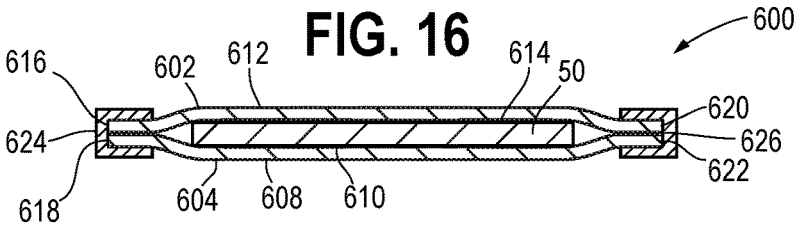
FIG. 16 is a section view of the carrier of FIG. 16 taken along the line 16-16 of FIG. 15.

In some embodiments, the panels of a carrier may be secured to one another with a sealing medallion, a sticker, a wafer seal, and the like. Referring to FIGS. 15 and 16, a carrier 600 includes a first panel 602 and a second panel 604. The carrier 600 may also include an aperture 606 to facilitate hanging the carrier 600 on a display hook.

The first panel 602 includes an exterior surface 608 and an interior surface 610, and the second panel 604 includes an exterior surface 612 and an interior surface 614. A pack of collectible cards 50 may be disposed between the first panel 602 and the second panel 604, and the two panels 602,604 may be disposed such that the interior surfaces 610,614, respectively, thereof face one another. When the first panel 602 and second panel 604 are disposed in this manner, a first edge 616 of the first panel 602 is brought into alignment with a first edge 618 of the second panel 604, and a second edge 620 of the first panel 602 is brought into alignment with a second edge 622 of the second panel 604.

In some embodiments, the first and second panels 602,604 are secured to another along the first edges 616,618, respectively, thereof by a first sealing medallion 624. In particular, the first sealing medallion 624 is secured to the exterior surface 608 of the first panel 602 proximate the first edge 616 thereof, folded over the first edge 616 of the first panel 602 and the first edge 618 of the second panel 604, and secured to the exterior surface of 612 of the second panel 604.

In some embodiments, the carrier 600 may include a second sealing medallion 626 to secure the first and second panels 602,604 along the second edges 620,622, respectively, thereof. In such embodiments, the second sealing medallion 626 is secured to the exterior surface 608 of the first panel 602 proximate the second edge 620 thereof, folded over the second edge 620 of the first panel 602 and the second edge 622 of the second panel 604, and secured to the exterior surface 612 of the second panel.

The first panel 602 also includes a third edge 630 disposed between the first and second edges 616,620 thereof and a fourth edge 632 disposed opposite the third edge 630 and also between the first and second edges 616,620 of the first panel 602. The second panel includes a third edge 634 disposed between the first and second edges 618,620 thereof, respectively, and a fourth edge 636 disposed between the first and second edges 618,620 of the second panel 604 and opposite the third edge 634. It should be apparent that additional medallion seals (not shown) may be used along the third edges 630,634 of the first and second panels 602,602, respectively, and/or the fourth edges 632, 636 of the first and second panels 602,604, respectively, to facilitate securing such panels to one another.

Figure 17:
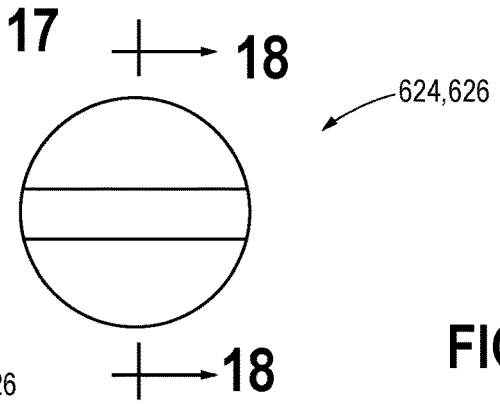
FIG. 17 is a plan view of a medallion seal that may be used with any of the carriers disclosed herein.
Figure 18:
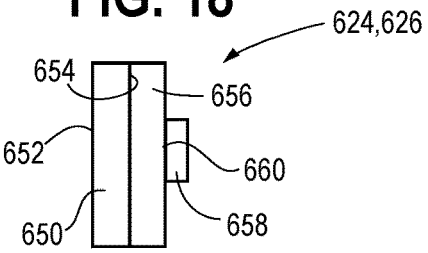
FIG. 18 is a section view of one embodiment of the medallion seal of FIG. 17 taken along the line 18-18 of FIG. 17.

Referring also to FIGS. 17 and 18, in some embodiments, the sealing medallion 624,626 includes a substrate 650 that has an exterior surface 652 and an interior surface 654. When such sealing medallion 624,626 is used to secure the first and second panels 602,604 to one another, the interior surface 654 faces the exterior surfaces 608,612 of the first and second panels 602,604, respectively. In some embodiment, an adhesive layer 656 is applied to the interior surface 654 and a deadener layer 658 is applied on top of a portion 660 of adhesive layer 656 that is to face the edges of the first and second panel 602,604. That is, the deadener layer 658 is applied to that portion 660 of the sealing medallion that is not expected to be in contact with either of the exterior surface 608,612. The deadener layer 658 prevents the pack of collectible cards from inadvertently becoming attached to the sealing medallion 624,626. It should be apparent to one who has ordinary skill in the art that the adhesive layer 656 may be entirely exposed (i.e., without any deadener applied thereon or gap).

Figure 19:
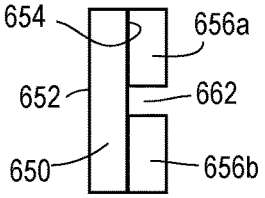
FIG. 19 is a section view of another embodiment of the medallion seal of FIG. 17 taken along the line 18-18 of FIG. 17.

Referring to FIG. 19, in some embodiments, the sealing medallion 624,626 has a first adhesive layer 656*a* and a second adhesive layer 656*b* applied on the interior surface 654 thereof. In such embodiments, first adhesive layer 656*a* and the second adhesive layer 656*b* are separated by a gap 662, and the gap 662 spans the portion of the sealing medallion 624,626 that is not expected be in contact either of the exterior surfaces 608,612.

It should be apparent to one who has ordinary skill in the art, that the sealing medallion 624,626 may be circular, polygonal, ovate, or any other shape. Further, such sealing medallion 624,626 may have a hologram formed therein or other features that facilitate confirming authenticity of the carrier 600 and/or the pack of collectible cards 50 contained therein. Such sealing medallion 624,626 may have security features, in some embodiments, that facilitate detection of tampering with such medallions 624,626.

Further, the carrier 600 may include the sealing medallion 624 secured to the exterior face 608 of the first panel 602, folded over a plurality of the edges 616,620, 630, and 632, and secured the exterior face 612 of the second panel 604. For example, a central portion of such a medallion 624 may be secured to a central portion of the first panel 604 and secure the first and second panels 602,604 at multiple sides of the carrier 600.

The medallion 624,626 may be made of any material apparent to one of ordinary skill in the art including a transparent material, an opaque material, a plastic, paper, metallic foil, combinations thereof, and the like.

Figure 20:
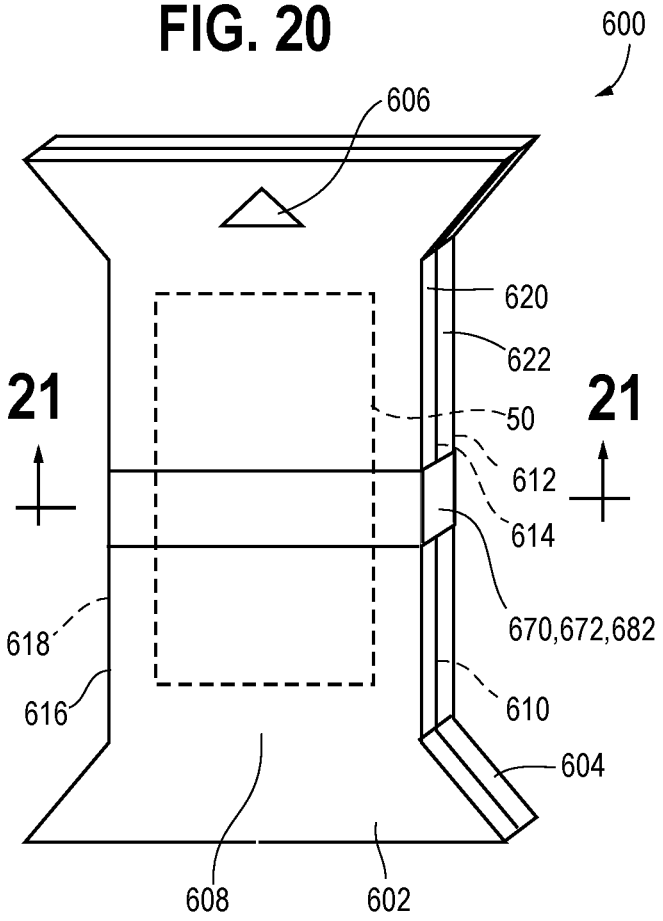
FIG. 20 is an isometric view of still another carrier.
Figure 21:
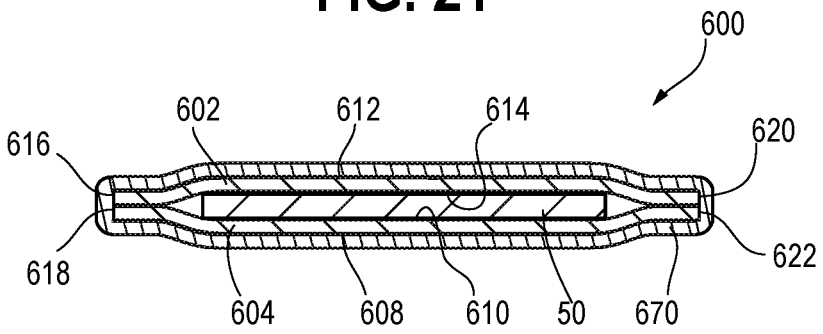
FIG. 21 is a section view of an embodiment of the carrier of FIG. 20 taken along the line 21-21.

Referring to FIG. 20, in some embodiments, a band 670,672,682 may be used to hold the first and second panels 602,604 adjacent one another. Referring also to FIG. 21, in one embodiment, the band 670 is a continuous loop of material that encircles the first and second panels 602,604.

Figure 22:
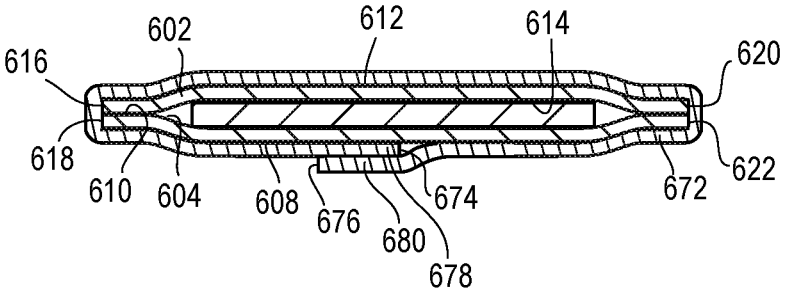
FIG. 22 is a section view of another embodiment of the carrier of FIG. 20 taken along the line 21-21.

Referring to FIGS. 20 and 22, in another embodiment, the band 672 is strip of material that includes a first end 674 opposite a second end 676. The band 672 also includes a first overlap portion 678 proximate the first end 674 and a second overlap portion 680 proximate the second end 676. When used to hold the first and second panels 602,604 adjacent one another, the band 672 is disposed to encircle the first and second panels 602,604. Thereafter, the first overlap portion 678 and the second overlap portion 680 are brought into overlap with one another and secured to one another using an adhesive or other securing means. It should be apparent to one who has ordinary skill in the art, that the first overlap portion 678 and the second overlap portion 680 may be disposed proximate or overlapping one or both of the edges 616,618, one or both of the edges 620,622, or any portion of the first and second panels 602,604.

Figure 23:
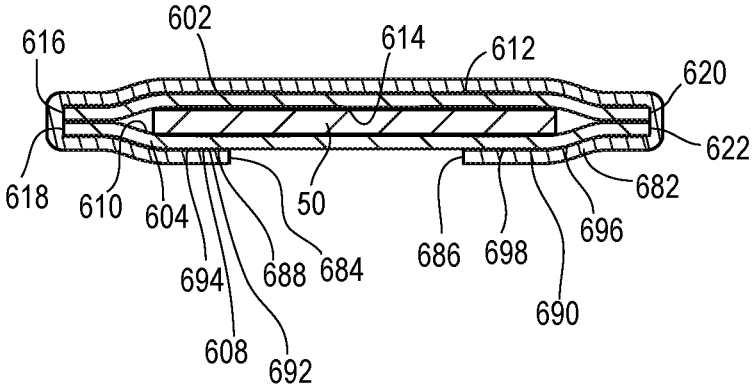
FIG. 23 is a section view of yet another embodiment of the carrier of FIG. 20 taken along the line 21-21.

Referring to FIGS. 20 and 23, in some embodiments, the band 682 is a strip of material that includes a first end 684 and a second end 686, a first securing portion 688 proximate the first end 684, and a second securing portion 690 proximate the second end 686. When used to hold the first and second panels 602,604 adjacent to one another, the first securing portion 688 is secured to a first portion 692 of the exterior surface 608 of the second panel 604. The band 682 is then disposed to encircle a second portion 694 of the second panel 604 between the first portion 692 and the first edge 618, the first panel 602, and a third portion 696 between the second edge 622 and a fourth portion 698 of the second panel 604. The securing portion 690 of the band 682 is then secured to the fourth portion 698. In some embodiments, when the band 682 is disposed in this manner, the first and second ends 684, 668 there are adjacent to one another, touching, or spaced apart.

The band 670,672 may be adhesively or otherwise secured at portions (not shown) of the exterior surfaces 608,612 of the first and second panels 602,604. Similarly, one or more portion(s) (not shown) other than the securing portions 688,690 of the band 682 may be adhesively or otherwise secured to corresponding portion(s) (not shown) of the exterior surface 612 of second panel 604 and/or one or more portion(s) of the band 682 may be secured to corresponding portion(s) (not shown) of the exterior surface 608 of the first panel 602.

The band 670,672,682 may be made of any material apparent to one of ordinary skill in the art including a transparent material, an opaque material, a plastic, paper, metallic foil, combinations thereof, and the like.

Figure 20A:
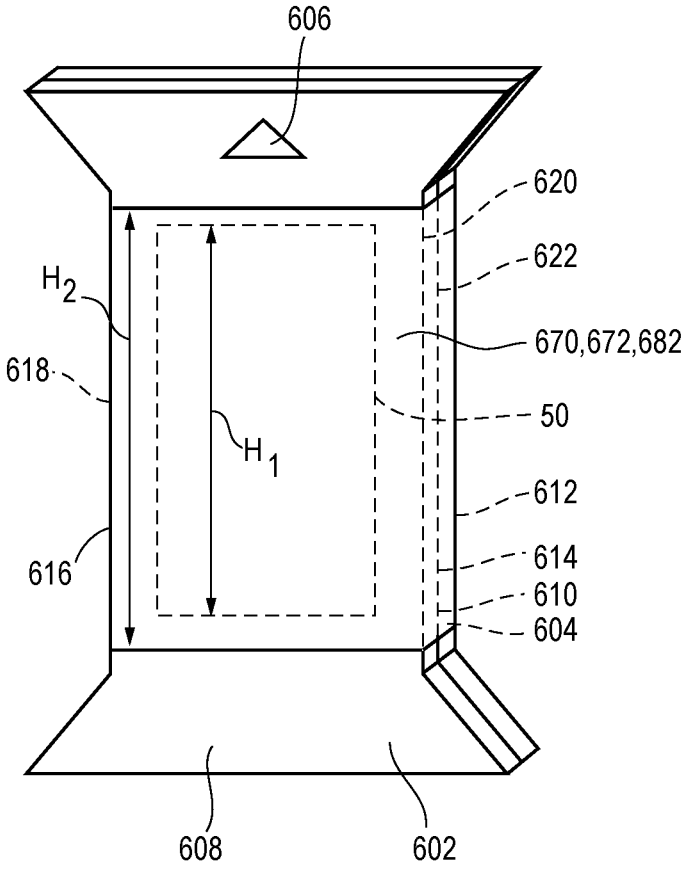
FIG. 20*a* is an isometric view of yet another carrier.

Referring to FIG. 20A, in some embodiments, the band 670,672,682 spans a substantial distance of the edges 616, 620 of the first panel 602 and the edges 618,622 of the second panel 604. In some embodiments, the band 670,627, 682 may have a length $H_2$ in a direction that spans between a top portion and a bottom portion of the carrier 600 that is larger than a length $H_1$ of packet of collectible cards 50 along such direction. In other embodiments, the length $H_2$ may less than or equal to the length $H_1$.

It should be apparent to one who has ordinary skill in the art that one or more sealing medallions, flaps, integral portions, accordion folded flaps, square folded flaps, bands, and the like may be used in any combination to secure first and second panels 602,604 proximate the edges thereof.

Figure 4:
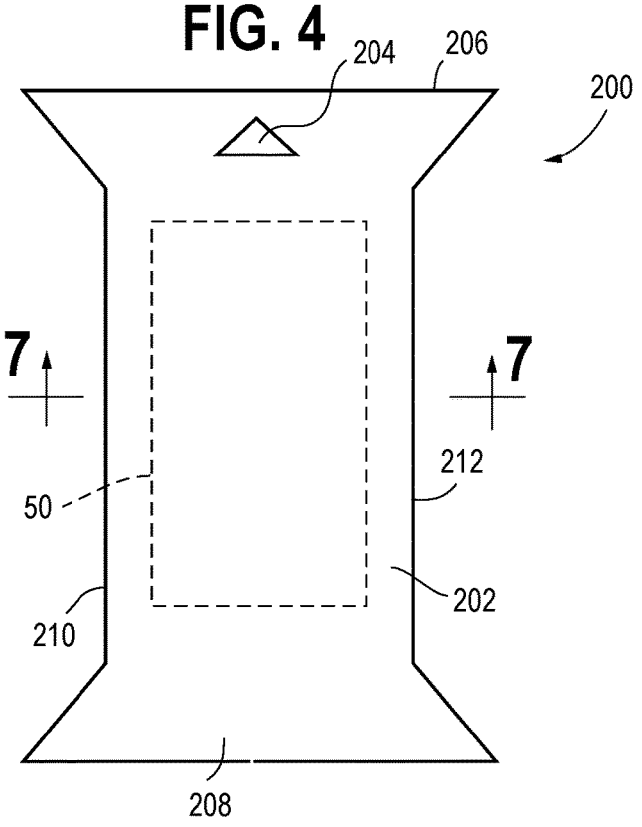
FIG. 4 is a plan view of another carrier.
Figure 5:
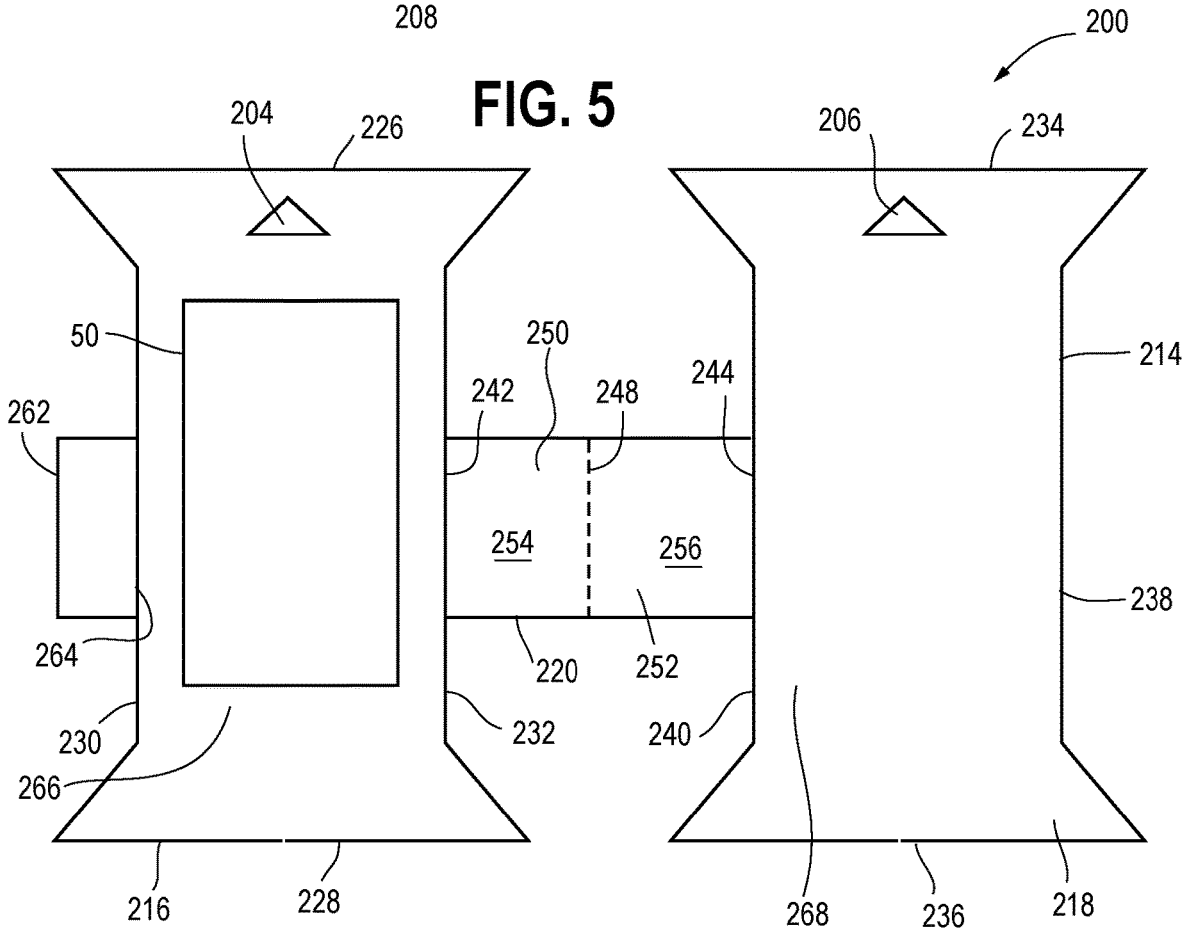
FIG. 5 is a plan view of an interior side of a substrate that may be used to form the carrier of FIG. 4.
Figure 6:
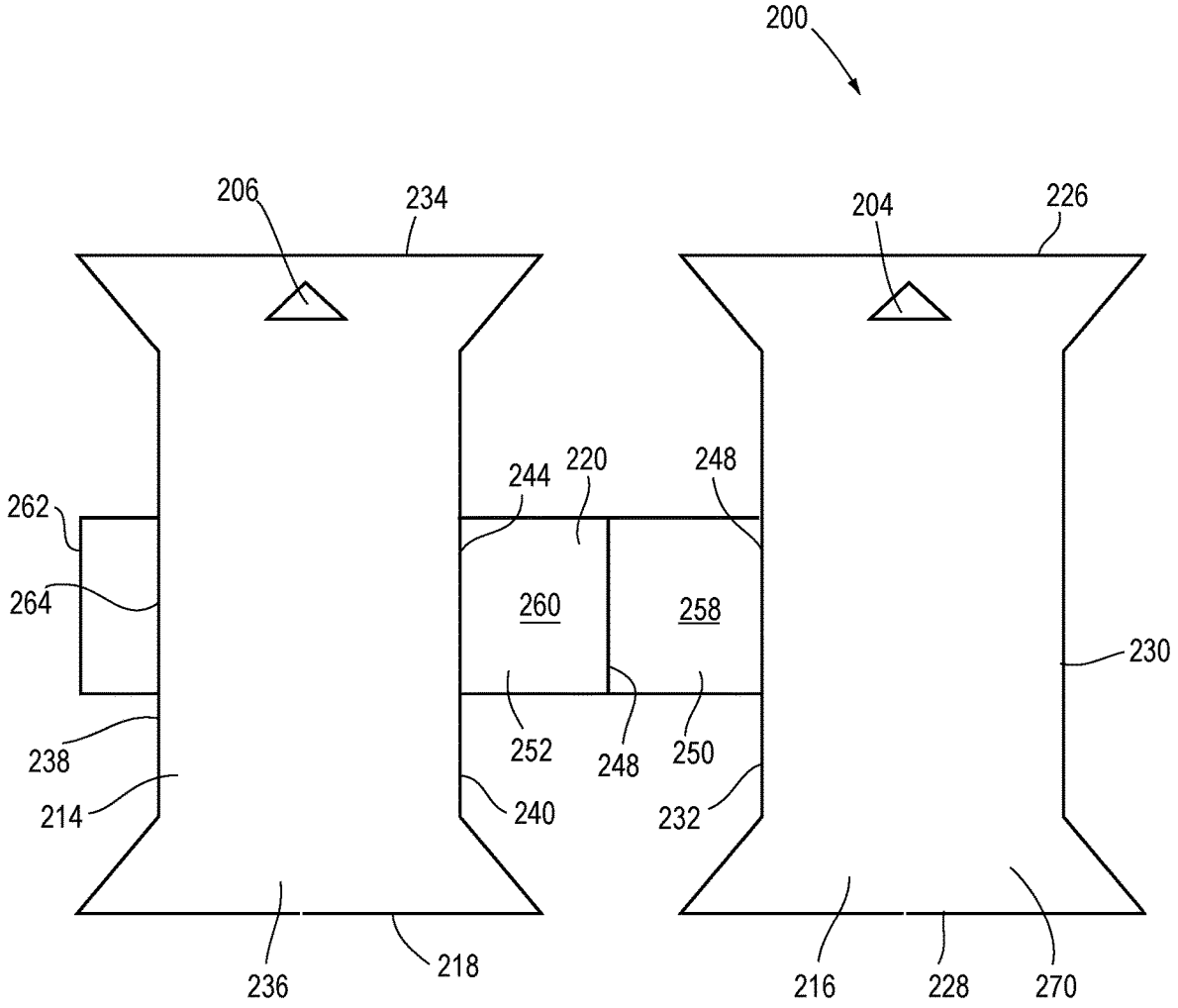
FIG. 6 is a plan view of an exterior side of the substrate of FIG. 5.
Figure 7:
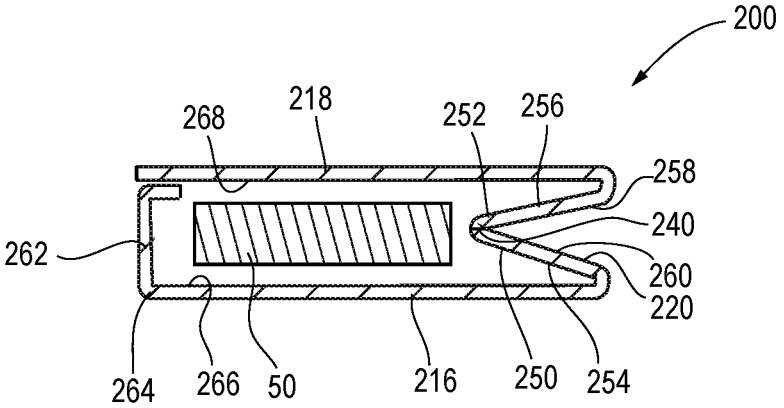
FIG. 7 is sectional view of the carrier of FIG. 4 taken along the line 7-7 of FIG. 4.

Referring to FIGS. 4, 12, and 15 In some embodiments, the sealing medallion 624 (FIG. 15) may be used to seal across the edges 616,618 in combination with a flap, e.g., flap 262 (FIG. 4) or 508 (FIG. 12), that extends from one such edge. For example, after the packet of collectible cards 50 is disposed on the second panel 604, the flap 262,508 may first be folded over the packet of collectible cards 50, and edge 616 of the first panel 602 brought into alignment with the edge 618 of the second panel 604. Thereafter, the sealing medallion 624 may be used to secure the first and second panels 602,604 together as describe above (see FIG. 15). In such embodiments, the flap 262,508 prevents packet of collectible cards 50 from sliding out from the interior of the carrier 600. Further, in such embodiments, no adhesive may be required to secure the flap 262,508 to the first or second panel 602,604 of the carrier 600. It should be apparent to one who has ordinary skill in the art, that flaps may be used in combination with the sealing medallions to secure the carrier at any of the edges thereof. Similarly, in some embodiments, one or more flaps (not shown) may be used to contain the packet of collectible cards 50 within the carrier 600, and the band 670,672,682 may be used to secure the panels 602,604 of such carrier 600.

As noted above, the substrate used to form the carriers may be formed by joining separate substrates to one another. Such separates substrates may be manufactured from the same material or different materials.

Any of the flaps, sealing medallions, band, and/or panels may include lines of weakness, pull tabs, and the like to facilitate opening the carrier to access the pack of collectible cards 50 enclosed therein.

Although the foregoing discloses the use adhesive to join components to one another, it should be apparent that any other means of fastening two components apparent to one of ordinary skill in the art may be used including riveting, stitching, and the like and combinations of such fastening means with adhesives.

The shapes and dimensions of the carriers and substrates disclosed herein are for illustrative purposes. It should be apparent to one who has skill in the art that carriers and substrates having other shapes may be formed in accordance with embodiments disclosed herein.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar references in the context of describing the invention (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the disclosure and does not pose a limitation on the scope of the disclosure unless otherwise claimed. No language in the specification should be construed as indicating any non-claimed element as essential to the practice of the disclosure.

Numerous modifications to the present disclosure will be apparent to those skilled in the art in view of the foregoing description. It should be understood that the illustrated embodiments are exemplary only, and should not be taken as limiting the scope of the disclosure.

I claim:

1. A game card carrier, comprising:

a first panel having a first interior surface and a first edge;

a second panel having a second interior surface and a second edge;

a connecting portion that joins the first panel and the second panel;

a game card disposed between the first and second panels; and a band;

wherein the first panel and the second panel are disposed such that the first interior surface and the second interior surface face one another, the first edge is in alignment with the second edge, the connecting portion is accordion folded and substantially enclosed between the first panel and the second panel, the band overlays at least a portion of the first panel and at least a portion of the second panel to hold the first panel and the second panel adjacent one another, the game card carrier includes an aperture therethrough, and a height of the band along the first edge is larger than a height of the game card.

2. The game card carrier of claim 1, wherein the band is a continuous loop of material that encircles the first and second panels.

3. The game card carrier of claim 1, wherein the band is a strip of material that includes a first end and a second end opposite the first end and the first end is secured to the second panel.

4. The game card carrier of claim 3, wherein the second end of the band is secured to the second panel spaced apart from the first end of the band.

5. The game card carrier of claim 1, wherein the band includes a first end, a second end, and an overlap portion proximate the first end and wherein the second end is secured to the overlap portion.

6. The game card carrier of claim 5, wherein the first end of the band is secured to the second panel.

7. The game card carrier of claim 1, wherein the first panel includes a third edge opposite the first edge, the second panel includes a fourth edge opposite the second edge, and the connecting portion joining the third edge and the fourth edge together.

8. The game card carrier of claim 7, wherein the connecting portion is integral with at least one of the first panel or the second panel.

9. The game card carrier of claim 7, wherein the connecting portion is a component separate from the first panel that is secured to the first panel.

10. The game card carrier of claim 1, wherein the first panel includes a first aperture in a first top portion thereof, the second panel includes a second aperture in a second top portion thereof, and the first and second panels are disposed such that at least a portion of the first aperture is aligned with at least a portion of the second aperture to form the aperture in the game card carrier.

11. A game card carrier, comprising:

a first panel having a first interior surface and a first edge;

a second panel having a second interior surface and a second edge;

a connecting portion that joins the first panel and the second panel; and a band;

wherein the first panel and the second panel are disposed such that the first interior surface and the second interior surface face one another, the first edge is in alignment with the second edge, the connecting portion is accordion folded and substantially enclosed between the first panel and the second panel, the band overlays at least a portion of the first panel and at least a portion of the second panel to hold the first panel and the second panel adjacent one another, and the game card carrier includes an aperture therethrough, and wherein the first edge is substantially linear, the first panel includes a top edge and a bottom edge, a first angled edge that connects the top edge and the first edge and a second angled edge that connects the bottom edge and the first edge, and wherein the first angled edge forms an acute angle with the top edge, the second angled edge forms an acute angle with the bottom edge, and the band is disposed between the first angled edge and the second angled edge.

12. The game card carrier of claim 11, wherein the band substantially spans a distance between the first angled edge and the second angled edge.

13. The game card carrier of claim 11 in combination with a game card disposed between the first and second panels, wherein a height of the band along the second edge is smaller than a height of the game card.

14. A game card carrier comprising:

a first panel having a first interior surface and a first edge;

a second panel having a second interior surface and a second edge;

a connecting portion that joins the first panel and the second panel;

a band; and an article disposed between the first panel and the second panel, wherein the first panel and the second panel are disposed such that the first interior surface and the second interior surface face one another, the first edge is in alignment with the second edge, the connecting portion is accordion folded and substantially enclosed between the first panel and the second panel, the band overlays at least a portion of the first panel and at least a portion of the second panel to hold the first panel and the second panel adjacent one another, and the first panel includes a window through which at least a portion of the article protrudes.

15. The game card carrier of claim 14, wherein the article is a pack of cards.

* * * * *